US007059705B2

(12) United States Patent
Iwata

(10) Patent No.: US 7,059,705 B2
(45) Date of Patent: Jun. 13, 2006

(54) WORKPIECE PROCESSING AND LIQUID DROPLET EJECTION INSPECTION APPARATUS

(75) Inventor: Yuji Iwata, Suwa (JP)

(73) Assignee: Seiko Epson Corporation (JP)

( * ) Notice: Subject to any disclaimer, the term of this patent is extended or adjusted under 35 U.S.C. 154(b) by 246 days.

(21) Appl. No.: 10/757,358

(22) Filed: Jan. 14, 2004

(65) Prior Publication Data

US 2004/0179060 A1 Sep. 16, 2004

(30) Foreign Application Priority Data

Jan. 15, 2003 (JP) ..... 2003-007511

(51) Int. Cl.
*B41J 23/00* (2006.01)

(52) U.S. Cl. ..... 347/37; 347/224; 118/712; 118/713; 219/121.78; 219/121.82; 219/181.83

(58) Field of Classification Search ..... None
See application file for complete search history.

(56) References Cited

U.S. PATENT DOCUMENTS 6,060,113 A * 5/2000 Banno et al. ..... 427/78
2005/0057580 A1* 3/2005 Yamano et al. ..... 345/690

FOREIGN PATENT DOCUMENTS

JP 08-084230 3/1996

* cited by examiner

*Primary Examiner*—Thinh Nguyen
*Assistant Examiner*—Brian J. Goldberg
(74) *Attorney, Agent, or Firm*—Harness, Dickey & Pierce, P.L.C.

(57) ABSTRACT

An apparatus for inspecting drawing accuracy in a liquid droplet ejection apparatus performs drawing by ejecting a function liquid droplet while moving a function liquid droplet ejection head relative to a workpiece by using a moving mechanism. In response to the relative movement, a laser irradiating mechanism performs visually recognizable stippling on the workpiece by irradiating coherent light thereon. A control part drives the laser irradiating mechanism for stippling at a predetermined frequency timing.

13 Claims, 10 Drawing Sheets

WORKPIECE PROCESSING AND LIQUID DROPLET EJECTION INSPECTION APPARATUS

RELATED APPLICATIONS

This application claims priority to Japanese Patent Application No. filed which is hereby incorporated by reference in its entirety.

BACKGROUND OF THE INVENTION

1. Field of the Invention

This invention relates to an inspection apparatus for inspecting a processing accuracy of a workpiece processing apparatus. This inspection apparatus inspects the landing accuracy of a function liquid droplet as ejected from a function liquid droplet ejection head, as represented by an ink jet head, in a liquid droplet ejection apparatus toward a workpiece such as a substrate. This invention also relates to an inspection apparatus for inspecting a drawing (image-forming) accuracy of a liquid droplet ejection apparatus, a liquid droplet ejection apparatus, a workpiece, an electro-optic device, a method of manufacturing an electrooptic device, and an electronic equipment.

2. Description of the Related Art

As this kind of conventional inspection apparatus as applied to in an ink jet printer, there is known the following in which a specific pattern image is printed onto a recording medium by means of a recording head, the pattern image is read out by a scanner, and then the read data is processed. Correction is thus made of an "irregular speed" of a moving mechanism (moving system) which reciprocates the recording head.

In the conventional ink jet printer (liquid droplet ejection apparatus), the pattern image printed on the recording medium (paper) contains a plurality of factors based not only on the "irregular speed" of the moving mechanism, but also on a warp ("wave or undulation") of a movement guide system, "slanted ejection" (curved flight) of ink and the like. Thus, inspection cannot be conducted accurately on the "irregular speed" alone. In other words, the pattern image contains a factor of defect based on mechanical accuracy of the moving mechanism and a factor of defect based on ejecting accuracy of the function liquid droplet ejection head, and these factors cannot be detected separately. Therefore, there has been a problem in that an appropriate measure cannot be taken for each of the factors separately.

SUMMARY OF THE INVENTION

It is an advantage of this invention to provide a processing accuracy inspection apparatus of a workpiece processing apparatus which is capable of distinguishing between bad or poor accuracy due to mechanical accuracy of a moving mechanism and the bad accuracy due to processing accuracy of a processing mechanism. It is also an advantage of this invention to provide an inspection apparatus for inspecting a drawing accuracy of a liquid droplet ejection apparatus, a liquid droplet ejection apparatus, a workpiece, an electro-optic device, a method of manufacturing an electro-optic device, and an electronic equipment.

According to one aspect of this invention, there is provided an inspection apparatus for inspecting a processing accuracy of a workpiece processing apparatus. The workpiece processing apparatus has a moving mechanism for mounting thereon a workpiece and a workpiece processing mechanism so that a workpiece surface is processed while performing a relative movement between the workpiece and the workpiece moving mechanism. The inspection apparatus comprises: stippling means mounted on the moving mechanism in a side-by-side relationship with the workpiece processing mechanism, the stippling means performing visibly recognizable stippling onto the workpiece by irradiating coherent light onto the workpiece as a result of relative movement between the workpiece and the workpiece processing mechanism; and stippling control means for driving the stippling means to perform the stippling at a predetermined frequency timing.

According to this arrangement, the stippling means is controlled by the stippling control means and irradiates the coherent light onto the workpiece at the predetermined frequency timing as the workpiece and the workpiece processing mechanism move relative to each other. Thus, the stippling means performs visually recognizable stippling. Accordingly, dots are marked on the workpiece by the stippling. An "irregular speed" of the moving mechanism, for example, is visually recognized as uneven pitches between the dots. Further, a "wavy" or undulating movement of the moving mechanism is visually recognized due to lack of straightness (i.e., deviation from straight line) in the plurality of dots. Simultaneously with the stippling, the workpiece is processed by the workpiece processing mechanism. When a processed portion of the workpiece is visually recognized, accuracy of the workpiece processing mechanism can be confirmed by means of dots and positional deviation as seen in the moving direction.

According to another aspect of this invention, there is provided an inspection apparatus for inspecting a drawing accuracy of a liquid droplet ejection apparatus. The liquid droplet ejection apparatus has a moving mechanism for mounting thereon a workpiece and a function liquid droplet ejection head, the moving mechanism performing a relative movement between the workpiece and the function liquid droplet ejection head so as to selectively eject the function liquid droplet from the function liquid droplet ejection head to perform drawing. The inspection apparatus comprises: stippling means mounted on the moving mechanism in a side-by-side relationship with the function liquid droplet ejection head, the stippling means performing visibly recognizable stippling onto the workpiece by irradiating coherent light onto the workpiece as a result of relative movement between the workpiece and the function liquid droplet ejection head; and stippling control means for driving the stippling means to perform the stippling at a predetermined frequency timing.

According to the above-described arrangement, the stippling means is controlled by the stippling control means and irradiates the coherent light onto the workpiece at the predetermined frequency timing as the workpiece and the function liquid droplet ejection head move relative to each other. Thus, the stippling means performs visually recognizable stippling. Accordingly, dots are marked on the workpiece by the stippling. An "irregular speed" of the moving mechanism, for example, is visually recognized as uneven pitches between the stippled dots. Further, a "wavy" movement of the moving mechanism is visually recognized as deviation of the plurality of stippled dots from a straight line. Simultaneously with the stippling, drawing is performed by the function liquid droplet ejection head. Therefore, defects can be confirmed as positional deviations of dots drawn by the function liquid droplet ejection head, from each of the stippled dots in a moving direction. The defects include: "slanted ejection" of the function liquid droplet from the function liquid droplet ejection head; inclination of the function liquid droplet ejection head (such as inclination with respect to the workpiece or the moving direction); and a reduction in speed of ejection (or flight) of the function liquid due to thickening.

Preferably, the inspection apparatus further comprises image recognition means for recognizing an image as a result of stippling by the stippling means.

According to the above-described arrangement, the stippled dots and the drawn dots are recognized as images. Thus the "irregular speed" and "wave" of the moving mechanism, the "slanted ejection" of the function liquid from the function liquid droplet ejection head or the like can be analyzed numerically. Thus, appropriate measures such as correction of moving mechanism and the maintenance of the function liquid droplet ejection head can be taken based on the analysis.

Preferably, the stippling means is made up of a laser irradiating mechanism which oscillates or focuses a laser beam.

According to the above-described arrangement, the stippled dots which are inspection standards can be stippled clearly to have smaller sizes than at least those of the drawn dots. Preferably, a semiconductor laser or a carbon dioxide laser is used for the laser emitting or irradiating mechanism.

Preferably, the stippling control means drives the stippling means to perform the stippling based on an ejection timing signal obtained from a head driver of the function liquid droplet ejection head.

Further, preferably, the function liquid droplet ejection head ejects a function liquid for drawing inspection purpose, and the stippling control means drives the stippling means to perform stippling in a manner synchronized with driving of the function liquid droplet ejection head.

According to the above-described arrangement, it is not required to generate stippling timing (data) exclusively used for the stippling means. In addition, a visual comparison can be easily made between the stippled dots and the drawn dots.

Preferably, the stippling control means comprises delaying means for delaying the stippling by the stippling means by a period equivalent to a duration from ejection of the function liquid by the function liquid droplet ejection head until landing of the function liquid on the workpiece.

According to the above-described arrangement, theoretically, the drawn dots and the stippled dots are drawn along the same line in a moving direction of the function liquid droplet ejection head and the stippling means. Thus, a comparison can be easily made between the drawn dots and the stippled dots without correction thereof. Accordingly, bad accuracy can be recognized instantly.

Preferably, the inspection apparatus further comprises a target plate provided in a side-by-side relationship with the workpiece, instead of a stippled portion of the workpiece.

Further, preferably, the inspection apparatus further comprises a dummy workpiece for inspection purpose, instead of the workpiece.

According to the above-described arrangement, the stippling is performed by the stippling means on the target plate or the dummy workpiece exclusively used for the stippling. Therefore, no stippling result remains on the workpiece itself. In addition, the surface of the workpiece does not need to be treated for the stippling. Preferably, the target plate is mounted on a work table where the workpiece is mounted. Further, it is preferred that the surface of the target plate or the dummy workpiece be treated to realize clear marking by the stippling means. For example, the surface thereof is applied with a coloring matter whose color is developed or changed by light which is irradiated from the stippling means. Furthermore, the stippled dots can be marked on the drawn dots so as to be visually recognizable by some surface treatment methods. Thus, bad accuracy can be visually recognized more clearly. Preferably, the target plate is provided not only with a stippling area but also with a drawing area for inspection.

According to another aspect of this invention, there is provided a liquid droplet ejection apparatus comprising the above-described inspection apparatus for inspecting a drawing accuracy of a liquid droplet ejection apparatus.

According to the above-described arrangement, an appropriate measure can be taken based on an inspection result from the drawing accuracy inspection apparatus. Namely, if bad accuracy is caused by the moving mechanism, measure can be taken, with respect to an "irregular speed," by controlling the speed of a motor (actuator) every second by corrected pulse widths and the like and, with respect to undulation, by correcting the place of disposing the moving mechanism or by replacing it. On the other hand, if bad accuracy is caused by the function liquid droplet ejection head, measure can be taken, with respect to "slanted ejection" of the function liquid, by cleaning of replacing the ejection head. Alternatively, if bad accuracy is caused by "inclination" of the ejection head, the ejection head is correctly re-attached to a carriage. Further, changes in an ejection or flight speed can be resolved by correcting the ejection timing.

According to another aspect of this invention, there is provided a workpiece which is stippled by the above-described liquid droplet ejection apparatus. The workpiece has, outside an area for function liquid droplet ejection, a stippling area for stippling by the stippling means and a drawing area for inspection purpose for drawing the function liquid droplet ejection head.

Preferably, the stippling area is coated with a coloring matter whose color is developed or changed by light irradiated from the stippling means.

According to the above-described arrangement, accuracy inspection can be easily carried out before primary drawing is performed onto the workpiece by the liquid droplet ejection apparatus. For example, with the liquid droplet ejection apparatus which performs drawing in an inert gas atmosphere, the inspection can be carried out without destroying the atmosphere. Preferably, the stippling area and the drawing area for inspection are set to unnecessary portions (non-drawing areas) of the workpiece, such as a peripheral portion or a portion to be cut off ultimately.

According to another aspect of this invention, there is provided an electro-optic device comprising a deposited portion formed by ejecting a function liquid onto a workpiece from the function liquid droplet ejection head, by using the above-descried liquid droplet ejection apparatus.

Further, according to another aspect of this invention, there is provided a method of manufacturing an electro-optic device in which a deposited portion is formed by ejecting a function liquid droplet onto a workpiece from the function liquid droplet ejection head, by using the above-described liquid droplet ejection apparatus.

According to the above-described arrangement, the electro-optic device is manufactured by using the liquid droplet ejection apparatus having good drawing accuracy (landing accuracy of the function liquid). Thus, the high quality electro-optic device can be manufactured. A liquid crystal display device, an organic electro-luminescence (EL) device, an electron-emitting device, a plasma display panel (PDP) device, an electrophoretic display device or the like is considered as the electro-optic device. In addition, color filters used in the above devices may also be considered as the electro-optic device. The electron-emitting device is a concept including a so-called field emission display (FED) device. Furthermore, the electro-optic device includes a device in which metal wiring, a lens, resist, a light diffuser or the like is formed.

According to another aspect of this invention, there is provided an electronic equipment having mounted thereon the above-described electro-optic device or the electro-optic device manufactured by the above-described method of manufacturing an electro-optic device.

In the above case, the electronic equipment is applied to a portable telephone, a personal computer, and other various kinds of electric products in which a so-called flat panel display is mounted.

BRIEF DESCRIPTION OF THE DRAWINGS

The above and other objects and the attendant features of the preset invention will become readily apparent by reference to the following detailed description when considered in conjunction with the accompanying drawings wherein.

DETAILED DESCRIPTION OF THE PREFERRED EMBODIMENTS

With reference to the attached drawings, a description will be made about a case in which an inspection apparatus for inspecting a processing accuracy of a workpiece processing apparatus as well as an inspection apparatus for inspecting a drawing accuracy of a liquid droplet ejection apparatus are applied to a liquid droplet ejection apparatus. The liquid droplet ejection apparatus in this embodiment employs a function liquid droplet ejection head (or heads) and ejects a function liquid (or liquids) toward a substrate which is a workpiece, thereby forming a deposited portion (film-forming portion) on the substrate. This film-forming or depositing work is also referred to as a workpiece processing (details thereof will be described hereinafter).

Figure 1:
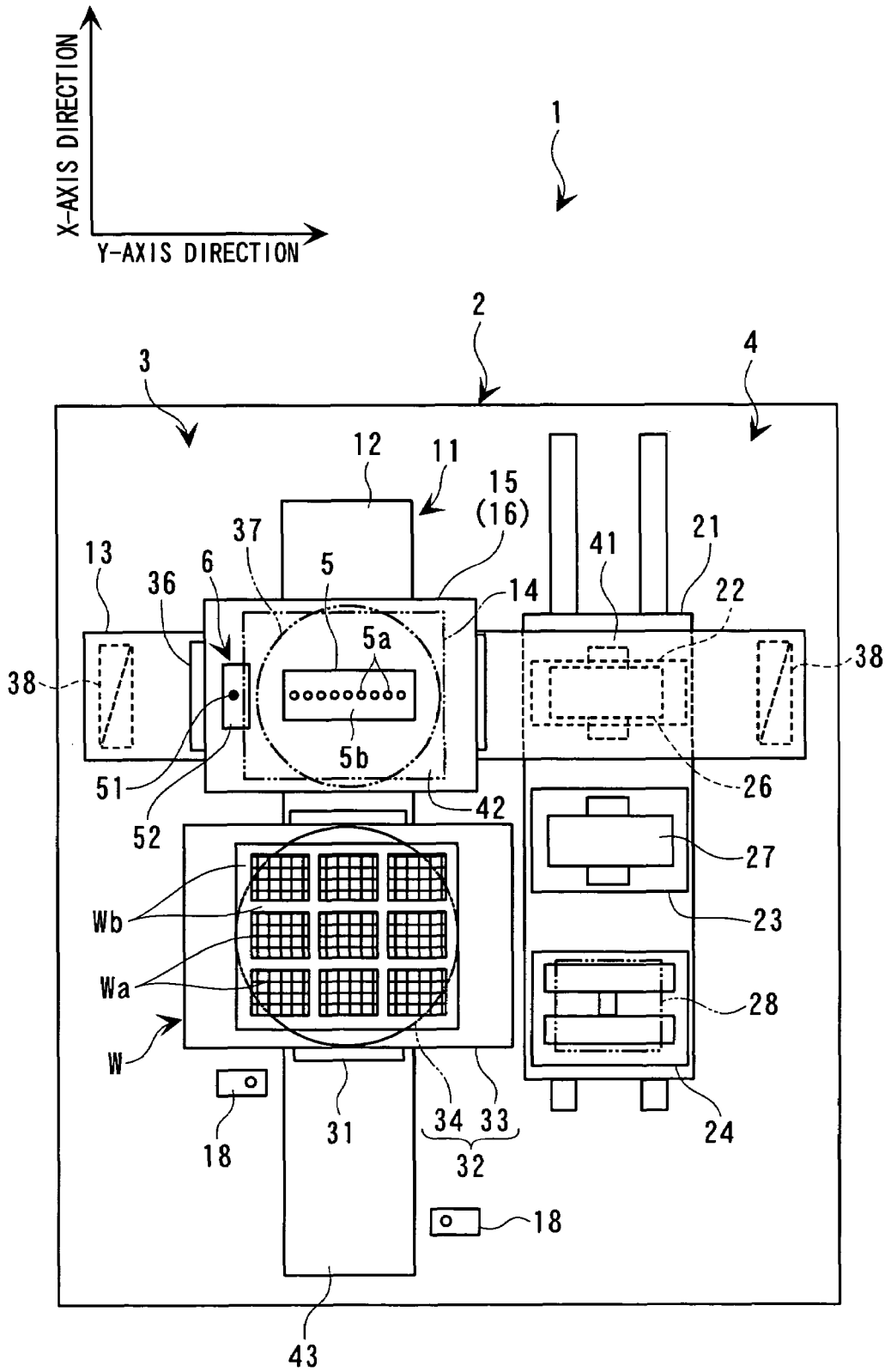
FIG. 1 is a plan view schematically showing a liquid droplet ejection apparatus according to an embodiment of the present invention.
Figure 2:
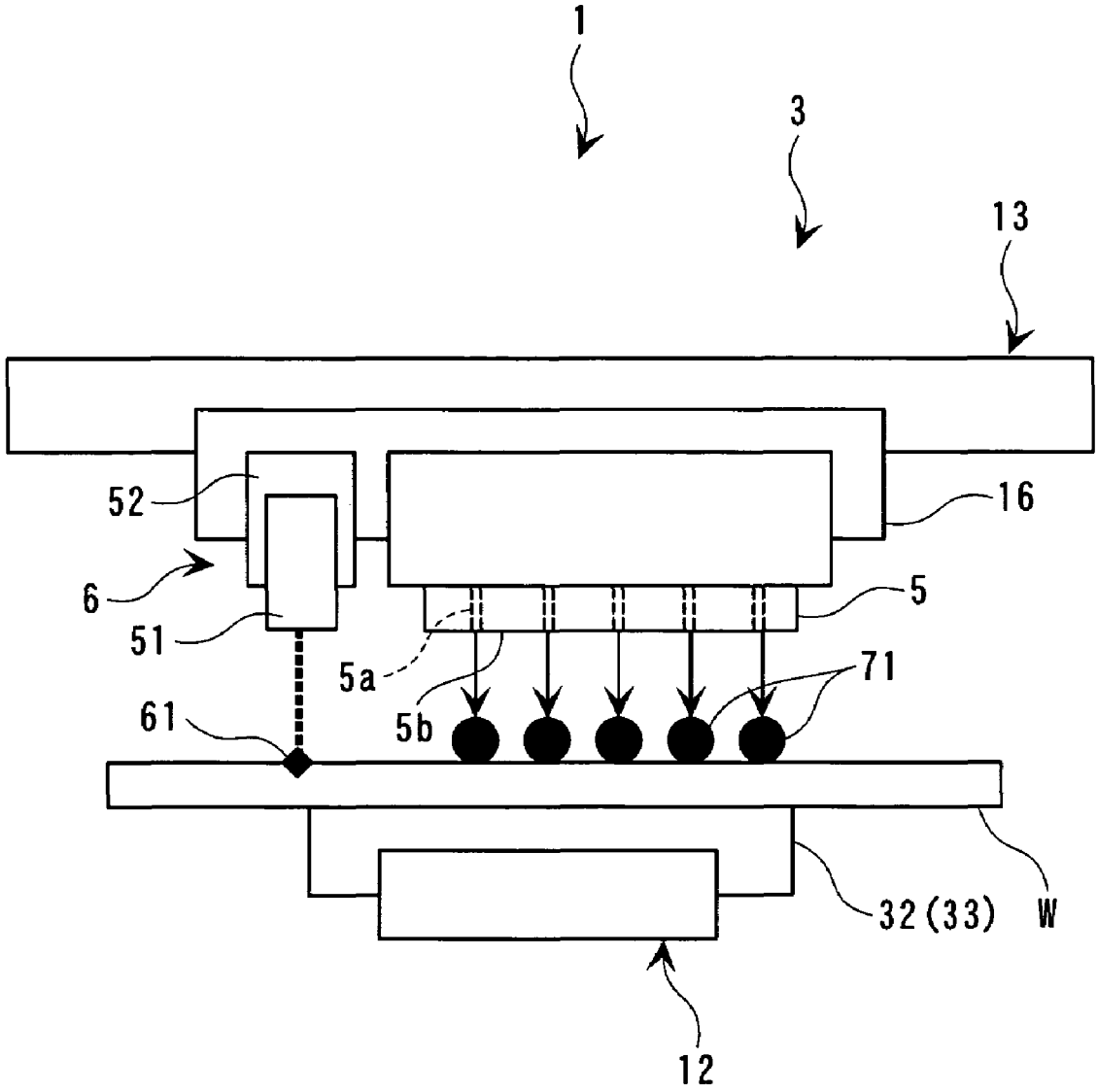
FIG. 2 is a front view schematically showing the liquid droplet ejection apparatus according to the embodiment.

As shown in a schematic plan view of FIG. 1 and a schematic front view of FIG. 2, a liquid droplet ejection apparatus 1 of this embodiment includes a stand 2, a drawing apparatus 3 mounted over an entire area of the stand 2, and a head function recovery apparatus 4 mounted on an edge of the stand 2. The drawing apparatus 3 performs drawing on a workpiece W by using a function liquid. The head function recovery apparatus 4 performs processing to recover a function (maintenance) of a function liquid droplet ejection head 5, which is included in the drawing apparatus 3, as needed.

The drawing apparatus 3 is provided with a moving mechanism 11 made up of an X-axis table 12 and a Y-axis table 13 which is perpendicular to the X-axis table 12, a main carriage 14 movably attached to the Y-axis table 13, and a head unit 15 provided to the main carriage 14 in a hanging condition. In addition, the function liquid droplet ejection head 5 and a laser irradiating apparatus 6 used for inspection are mounted on the head unit 15 through a sub-carriage 16. In this case, the workpiece W, which is a substrate, is mounted on the X-axis table 12 and positioned by a pair of workpiece recognition cameras 18 and 18 provided near one end of the X-axis table 12. One function liquid droplet ejection head 5 is mounted on the sub-carriage 16 in the drawing. However, a plurality of the function liquid droplet ejection heads 5 may be mounted thereon.

The head function recovery apparatus 4 is provided with a moving table 21 mounted on the stand 2 as well as a storage unit 22, a suction unit 23 and a wiping unit 24 which are mounted on the moving table 21. When an operation of the apparatus is stopped, nozzles 5*a* of the function liquid droplet ejection head 5 are sealed by the storage unit 22 so that the nozzles 5*a* are prevented from drying. The suction unit 23 forcibly or positively sucks the function liquid from the function liquid droplet ejection head 5 and functions as a flashing box which receives the function liquid ejected from all of the nozzles 5*a* of the function liquid droplet ejection head 5. The wiping unit 24 mainly wipes a nozzle surface 5*b* of the function liquid droplet ejection head 5 after the suction of the function liquid is performed.

The storage unit 22 is provided, e.g., with a sealing cap 26. The sealing cap 26 corresponds to the function liquid droplet ejection head 5 and can be lifted and lowered. When the operation of the apparatus is stopped, the sealing cap 26 is lifted to face (the function liquid droplet ejection head 5 of) the head unit 15 and contacts the nozzle surface 5*b* of the function liquid droplet ejection head 5 to seal the nozzle surface 5*b*. Thus, the function liquid on the nozzle surface 5*b* of the function liquid droplet ejection head 5 is prevented from vaporizing. Consequently, so-called nozzle clogging is prevented.

Similarly, the suction unit 23 is provided, e.g., with a suction cap 27. The suction cap 27 corresponds to the function liquid droplet ejection head 5 and can be lifted and lowered. When filling (the function liquid droplet ejection head 5 of) the head unit 15 with the function liquid, or removing the function liquid thickened within the function liquid droplet ejection head 5, the suction cap 27 contacts the function liquid droplet ejection head 5 and carries out pump suction. Further, when the function liquid droplet ejection (drawing) is suspended, the suction cap 27 is slightly spaced from the function liquid droplet ejection head 5 and performs flashing (waste ejection). Thus, nozzle clogging is prevented, or the function of the function liquid droplet ejection head 5 where the nozzles were clogged is recovered.

The wiping unit 24 is provided, e.g., with a wiping sheet 28 which can be reeled off and taken up. The wiping unit 24 being reeled off wipes the nozzle surface 5*b* of the function liquid droplet ejection head 5 while sending the wiping sheet 28 and moving the wiping unit 24 in an X-axis direction by using the moving table 21. Thus, the function liquid attached on the nozzle surface 5*b* of the function liquid droplet ejection head 5 is removed, preventing slanted ejection or the like of the function liquid when ejected.

Further, though not illustrated, a function liquid supply mechanism, control means (to be described later) 7 and the like are incorporated in this liquid droplet ejection apparatus 1. The function liquid supply mechanism supplies the function liquid to each of the function liquid droplet ejection heads 5. The control means 7 controls over constituent apparatuses of the liquid droplet ejection apparatus 1, such as the above-described drawing apparatus 3, the function liquid droplet ejection head 5 and the like.

The X-axis table 12 has an X-axis slider 31, which is driven by a motor and configures a driving system in an X-axis direction. A set table 32 made of the suction table 33, a θ table 34 and the like are movably mounted on the X-axis slider 31, thus configuring the X-axis table 12. Similarly, the Y-axis table 13 has a Y-axis slider 36 which is driven by a motor and configures a driving system in a Y-axis direction. The foregoing main carriage 14 is movably mounted on the Y-axis slider 36 through a θ table 37, thus configuring the Y-axis table 13.

In this case, the X-axis table 12 is directly supported on the stand 2 whereas the Y-axis table 13 is supported by right and left columns 38 and 38 standing on the stand 2. The X-axis table 12 and the head function recovery apparatus 4 are provided to be parallel to each other in the X-axis direction. The Y-axis table extends, crossing over the X-axis table 12 and the moving table 21 of the head function recovery apparatus 4.

The Y-axis table 13 moves the head unit (the function liquid droplet ejection head 5) 15 mounted thereon between a function recovery area 41 and a drawing area 42 as appropriate. The function recovery area 41 is positioned directly above the head function recovery apparatus 4, and the drawing area 42 is positioned directly above the X-axis table 12. Namely, the Y-axis table 13 moves the head unit 15 to the function recovery area 41 for recovering the function of the function liquid droplet ejection head 5. Additionally, the Y-axis table 13 moves the head unit 15 to the drawing area 42 for performing the drawing on the workpiece W that is introduced to the X-axis table 12.

Meanwhile, an end portion of the X-axis table 12 is used as a transfer area 43 where the workpiece W is set (transferred) onto the X-axis table 12. In the transfer area 43, the above-described pair of workpiece recognition cameras 18 and 18 are provided. By using these workpiece recognition cameras 18 and 18, two reference marks on the workpiece W supplied onto the suction table 33 are recognized at the same time, and the workpiece W is aligned based on a recognition result.

In the liquid droplet ejection apparatus 1 of this embodiment, the drawing is performed based on ejection pattern data stored in the foregoing control means 7, wherein movement of the workpiece W in the X-axis direction is referred to as main scanning, and movement of the function liquid droplet ejection head (head unit 15) 5 in the Y-axis direction is referred to as sub scanning.

When the drawing is performed on the workpiece W introduced to the drawing area 42, the function liquid droplet ejection head (head unit 15) 5 is brought to the drawing area 42 and driven to eject the function liquid (selectively eject the function liquid), synchronously with the main scanning (reciprocating movement of the workpiece W) by the X-axis table 12. In addition, the sub scanning (movement of the head unit 15) is performed by the Y-axis table 13 as appropriate. With a series of above-described operations, a desired function liquid is selectively ejected, in other words, the drawing is performed, in a drawing region Wa of the workpiece W.

Further, when recovering the function of the function liquid droplet ejection head 5, the suction unit 23 is moved to the function recovery area 41 by the moving table 21 and the head unit 15 is moved to the function recovery area 41 by the Y-axis table 13. Thereafter, flushing or pump suction is performed in the function liquid droplet ejection head 5. In case where the pump suction of the function liquid is performed, the moving table 21 moves the wiping unit 24 to the function recovery area 41 after the pump suction, to wipe the function liquid droplet ejection head 5. Similarly, when operations are finished and thus the operation of the apparatus is stopped, the storage unit 22 caps the function liquid droplet ejection head 5.

Meanwhile, the laser irradiating apparatus 6 mounted on the sub-carriage 16 of the head unit 15 together with the function liquid droplet ejection head 5 emits or irradiates coherent light onto the workpiece at a predetermined frequency timing. The laser irradiating apparatus 6 is configured by a semiconductor laser 51 provided downward and an oscillation unit 52 which oscillates the laser beam of the semiconductor laser 51. In this case, the laser irradiating apparatus 6 stipples the workpiece W by irradiating a laser beam corresponding to an ejection operation for inspection by the function liquid droplet ejection head 5 (see FIG. 3). In other words, the laser irradiating apparatus 6 irradiates a laser beam synchronously with drive of the function liquid droplet ejection head 5 to stipple the workpiece W (details are described later). The laser irradiating apparatus 6 may stipple not only by oscillating the laser beam but also by focusing the same. Further, a carbon dioxide laser can be used instead of the semiconductor laser 51.

Figure 4:
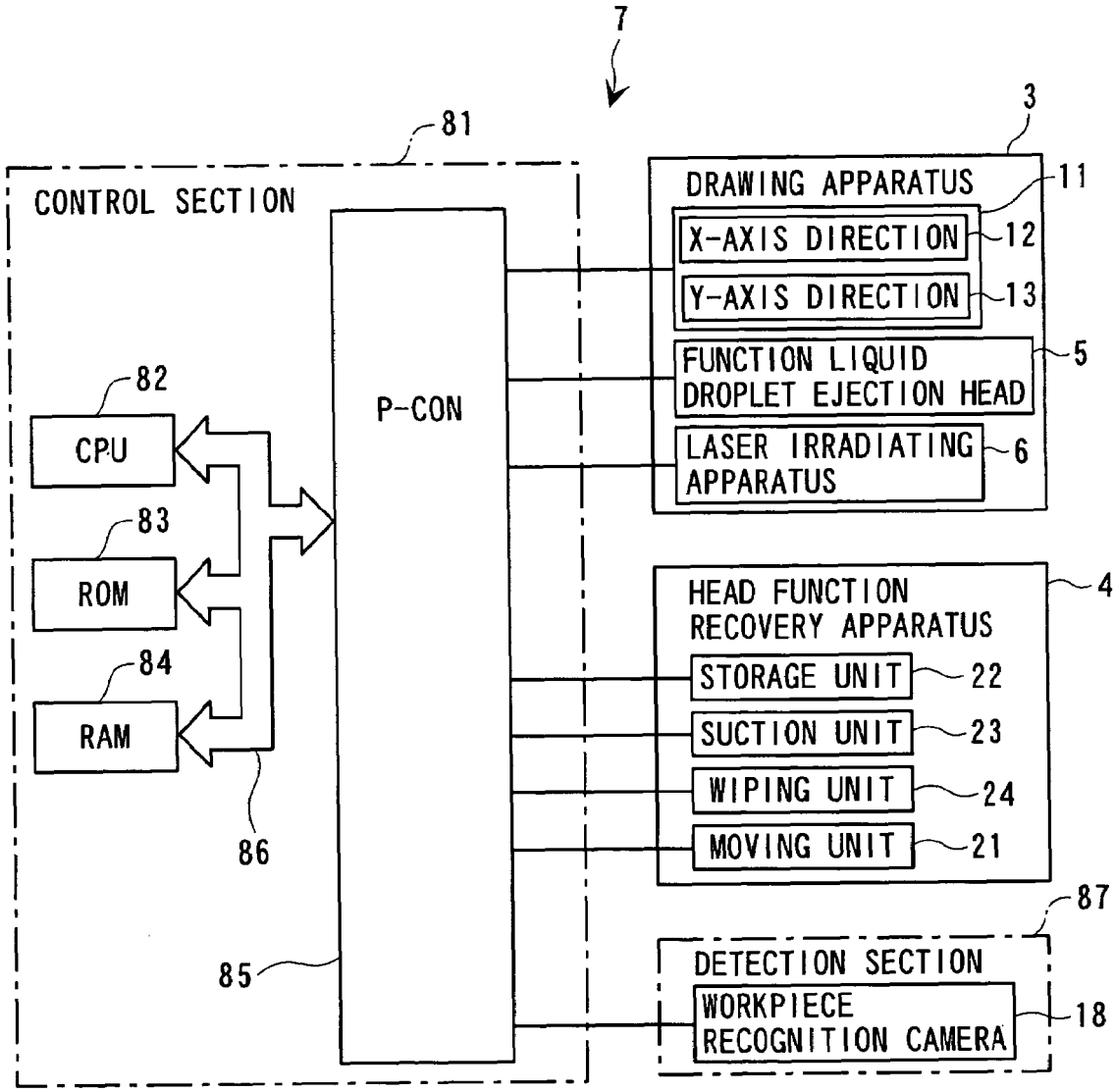
FIG. 4 is a block diagram showing control means of the liquid droplet ejection apparatus.

As shown in FIG. 4, the control means 7 is provided with a control section 81 which controls each kind of operation of the liquid droplet ejection apparatus 1. The control section 81 includes a central processing unit (CPU) 82 which performs various kinds of control, a read only memory (ROM) 83, a random access memory (RAM) 84 and an interface 85, and all of them are connected to each other through a bus 86. The ROM 83 has an area to store a control program and control data that are to be processed by CPU 82. The RAM 84 is used as a work area for various kinds of control processes. In the interface 85, a logic circuit is incorporated. The logic circuit complements a function of the CPU 82 and manages interface signals to and from peripheral circuits.

The foregoing X-axis table 12, the Y-axis table 13, the function liquid droplet ejection head 5, the laser irradiating apparatus 6, and the head function recovery apparatus 4 are connected to the interface 85 through drivers (not illustrated), respectively. In addition, the foregoing workpiece recognition cameras 18 and 18 are connected to the interface 85 as a detection section 87. In accordance with the control program within the ROM 83, the CPU 82 inputs various kinds of detection signals, instructions, and data through the interface 85 to control various kinds of data (ejection pattern data) and the like within the RAM 84. The CPU 82 then outputs various kinds of control signals through the interface 85.

In other words, the CPU 82 controls ejection by the function liquid droplet ejection head 5 and also controls movements of the X-axis table 12 and the Y-axis table 13 so that the drawing (liquid droplet ejection) is performed on the workpiece W. Further, the CPU 82 controls the laser irradiating apparatus 6 so that the workpiece is stippled by laser irradiation. In addition, once the workpiece W is set, the CPU 82 corrects an angle of the workpiece W on the X-axis table 12 and the ejection pattern data (ejection timing), based on the result of recognition by the workpiece recognition cameras 18. Moreover, when maintenance is periodically provided for the function liquid droplet ejection head 5, the CPU 82 controls the storage unit 22, the suction unit 23, the wiping unit 24 and the like of the head function recovery apparatus 4.

Figure 5:
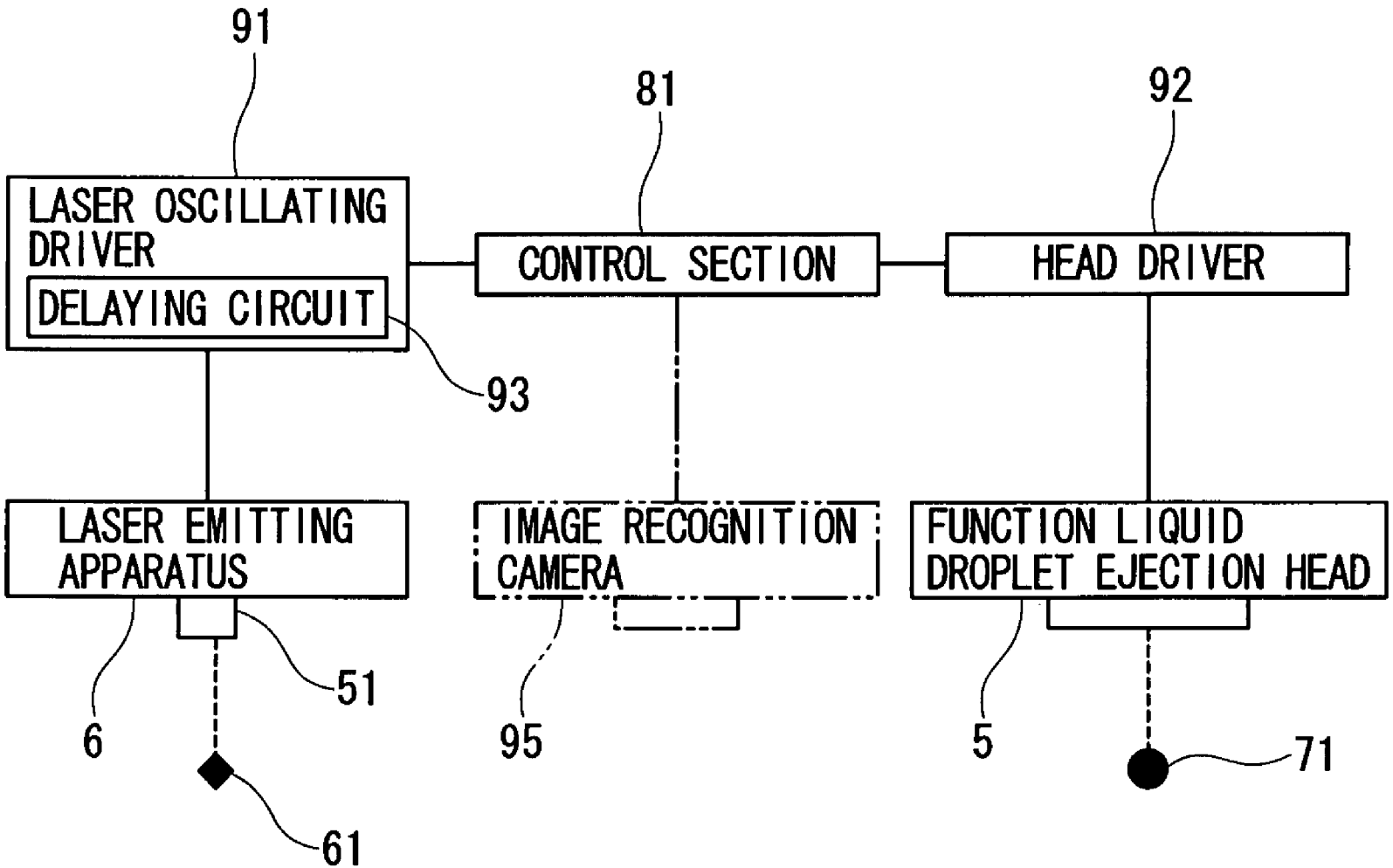
FIG. 5 is a block diagram showing control system around a laser irradiating apparatus.

FIG. 5 is a block diagram of the control means 7 around the laser irradiating apparatus 6. The laser irradiating apparatus (stippling means) 6 is connected to a laser oscillating driver (stippling control means) 91 which drives the laser irradiating apparatus 6 to oscillate, and the laser oscillating driver 91 is connected to the control section 81. Further, the function liquid droplet ejection head 5 is connected to the control section 81 through a head driver 92. The CPU 82 of the control section 81 outputs an ejection timing signal of the head driver 92 to the laser oscillating driver 91. The laser oscillating driver 91 generates an oscillation timing by delaying the ejection timing signal by using a delaying circuit (delaying means) 93, and then the laser irradiating apparatus 6 is driven to stipple based on the oscillation timing.

Figure 3:
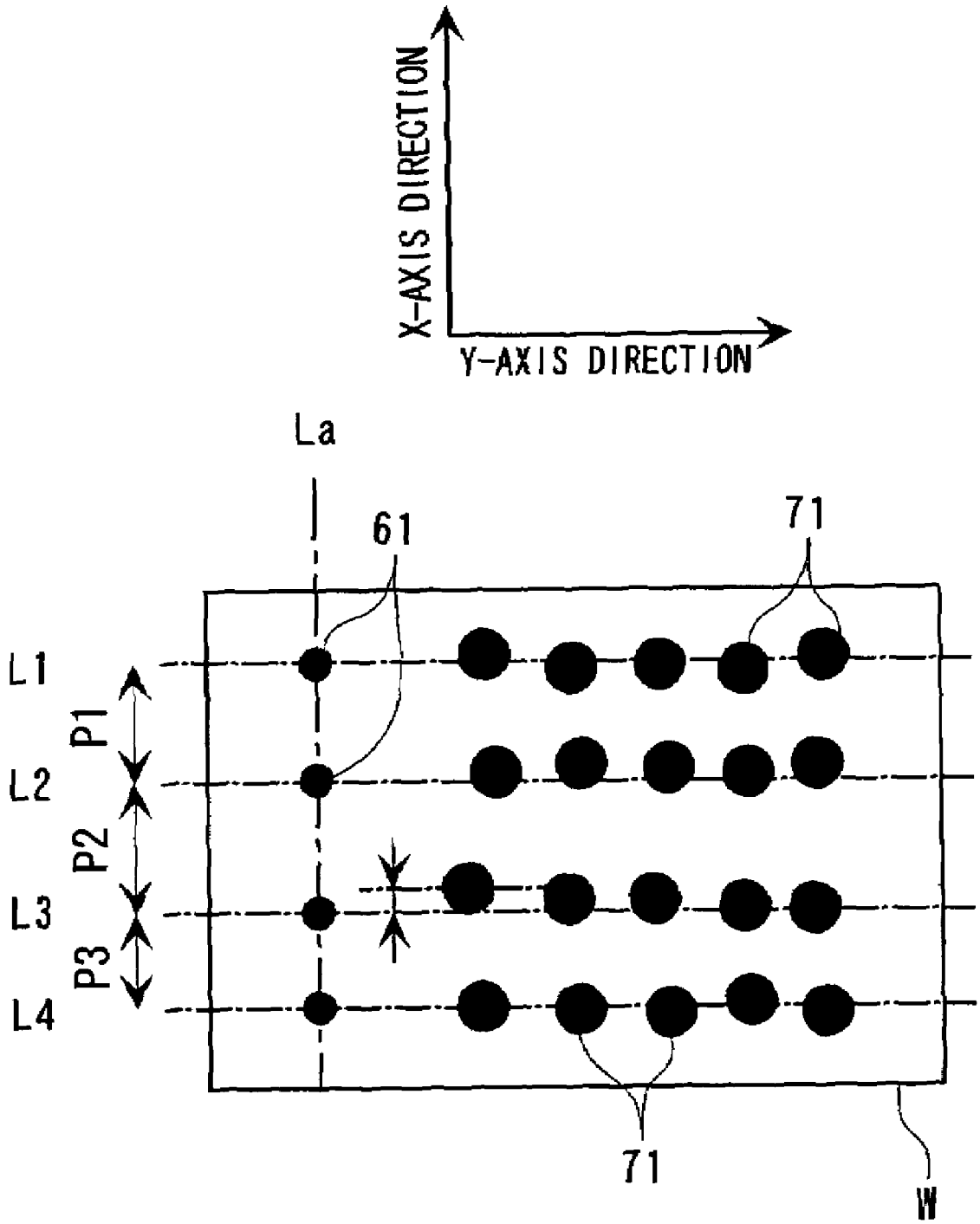
FIG. 3 is a plan view showing states of drawn dots and stippled dots which represent an inspection result from the liquid droplet ejection apparatus.

In this case, the delaying circuit 93 delays the stippling by the laser irradiating apparatus 6 by a period equivalent to a duration from liquid droplet ejection by the function liquid droplet ejection head 5 until landing of the liquid on the workpiece W. In other words, the delaying circuit 93 enables the function liquid to land onto the workpiece W simultaneously with irradiation (reaching) of the laser beam to the workpiece W. Accordingly, as shown in FIG. 3, stippled dots 61 on the workpiece W marked by laser irradiation and drawn dots 71 on the workpiece W drawn by liquid droplet ejection are theoretically aligned in the X-axis direction which is the main scanning direction. Thus, when those dots are not aligned, some kind of defect in drawing accuracy is visually recognized (details are described later).

As shown in FIG. 5, an image recognition camera (image recognition means) 95 may be connected to the control section 81 so that the stippled dots 61, a result of stippling, and the drawn dots 71, a result of drawing, are recognized as images. The stippled dots 61 and the drawn dots 71 on the workpiece W are recognizable by the naked eye. However, recognition of the spots as images makes it easier to compare both types of dots objectively and to convert the results of stippling and drawing into numbers. Thus, it becomes possible to generate corrected data for each of the dots.

FIG. 3 shows a state where all of (or a part of) the nozzles 5*a* of the function liquid droplet ejection head 5 eject the function liquid and the laser irradiating apparatus 6 stipples synchronously with the ejection. As shown in this drawing, the drawn dots 71 of the function liquid and the stippled dots 61 of laser beams are marked on the workpiece W at predetermined intervals in the X-axis direction (moving direction).

In this case, as for the stippled dots 61, a situation may occur in which dot pitches P1, P2 and P3 are uneven (nonuniform) as shown in FIG. 3, although the pitches are supposed to be even. From this result of stippling, a cause of the uneven pitches is considered to be an "irregular speed" of the X-axis table 12. Further, in this drawing, each of the stippled dots 61 is aligned along a line La. However, when the positions of these dots deviate from the line La, it is considered that the X-axis table 12 is "waved or undulated."

On the other hand, as for the drawn dots 71, for example, the drawn dots 71 are supposed to be drawn along the lines L1, L2, L3 and L4 passing through the stippled dots 61, respectively. However, in this drawing, the drawn dots 71 are drawn, while the positions thereof deviate from these lines (in vertical and horizontal directions as seen in the figure). From this result of drawing, a cause of the deviation is considered to be "slanted ejection (or flight)" of the function liquid from (specific nozzles 5*a* of) the function liquid droplet ejection head 5. Furthermore, if the (five) drawn dots 71 aligned side by side on each of the lines L1, L2, L3 and L4 are inclined as whole, it is considered that the function liquid droplet ejection head 5 is inclined in a plane (a θ direction).

Figure 6:
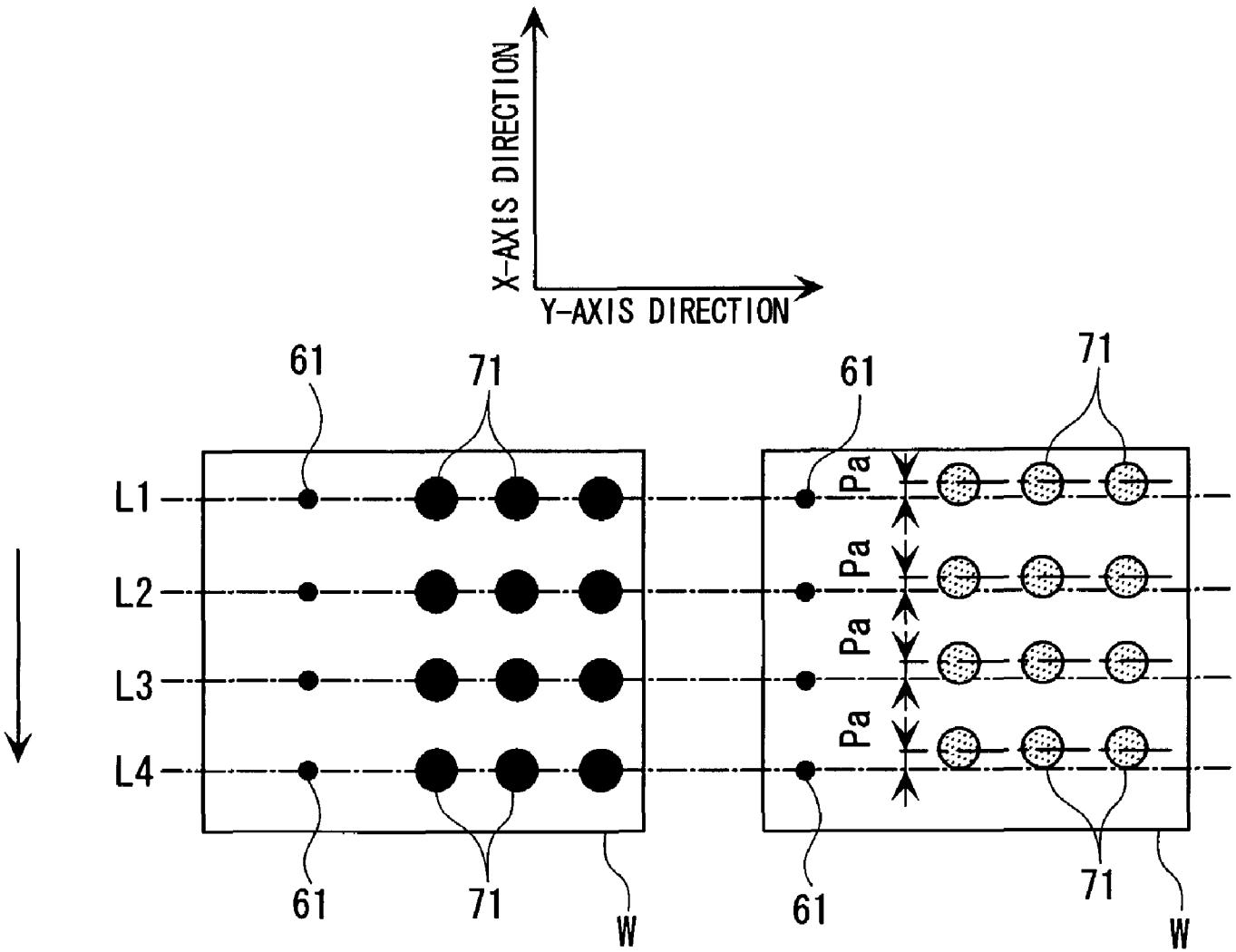
FIG. 6 is a plan view showing states of drawn dots and stippled dots which represent another inspection result.

Further, as shown in FIG. 6, the result of drawing is supposed to be the one shown on the left side of the figure. However, as shown on the right side of FIG. 6, the (three) drawn dots 71 aligned side by side along each of the lines L1, L2, L3 and L4 deviate from these lines as a whole. In this case, it is considered that an ejection speed of (each of. the nozzles 5*b* of) the function liquid droplet ejection head 5 is becoming slower (faster) as a whole; otherwise, it is considered that the function liquid droplet ejection head 5 is inclined with respect to a perpendicular direction.

As mentioned above, a comparison is made between the drawn dots 71 by the function liquid droplet ejection head 5 and the stippled dots 61 stippled by the laser irradiating apparatus 6 synchronously with the drawing. Consequently, it is found that defective stippling of the stippled dots 61 themselves results from mechanical accuracy and alignment accuracy of the moving mechanism (X-axis table 12) 11. It is also found that defective drawing of the drawn dots 71 with reference to the stippled dots 61 results from ejection accuracy and alignment accuracy of (each of the nozzles 5*a* of) the function liquid droplet ejection head 5. Therefore, it becomes possible to take appropriate measures such as making corrections or the like based on the inspection results.

Moreover, although not illustrated, the stippling by the laser irradiating apparatus may also be performed in a sub-scanning direction (Y-axis direction). Thus, mechanical accuracy and alignment accuracy of the Y-axis table can be inspected. Further, the stippling may be performed alone in both of the X-axis direction (main scanning direction) and the Y-axis direction (sub-scanning direction). Thus, mechanical accuracy and the like of the moving mechanism (X-axis table 12 and Y-axis table 13) 11 can be independently inspected. In this case, stippling can also be performed at a unique frequency.

Figure 7:
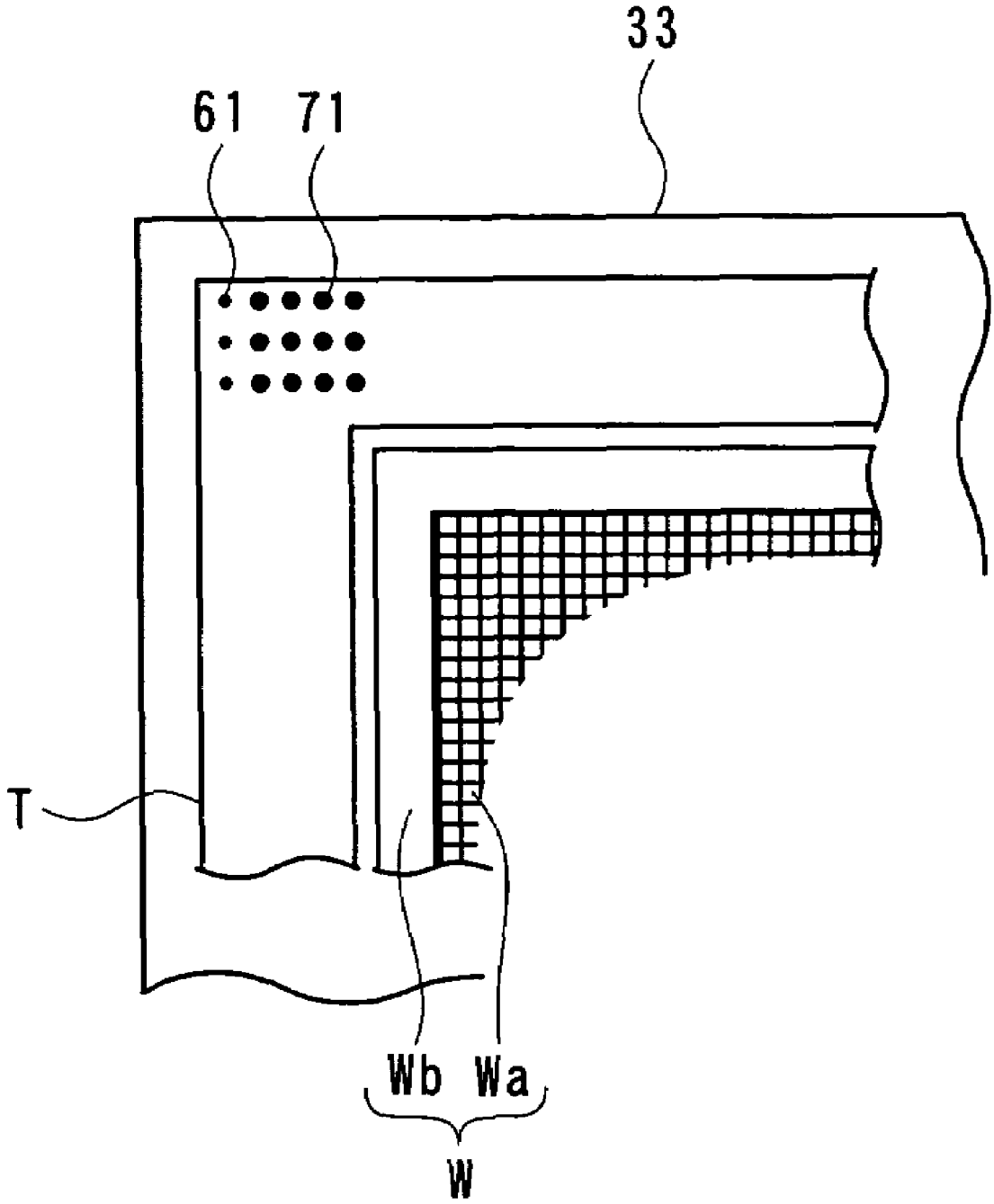
FIG. 7 is a plan view of a surrounding portion of a target plate provided on a suction table.

In this inspection, drawing and stippling for the inspection are performed on an unnecessary portion of the workpiece W, for example, a non-drawing region Wb including a peripheral portion, a portion to be cut off later and the like (see FIG. 1). Instead of the workpiece W, a dummy workpiece having the same form as the workpiece W may be introduced to the apparatus. Furthermore, as shown in FIG. 7, a target plate T may be provided on the suction table 33 so as to be adjacent to the workpiece. The target plate T is used for the above-described stippling and drawing for inspection. In addition, the target plate T preferably has, for example, an "L" shape along two sides of the workpiece W.

Figure 8A:
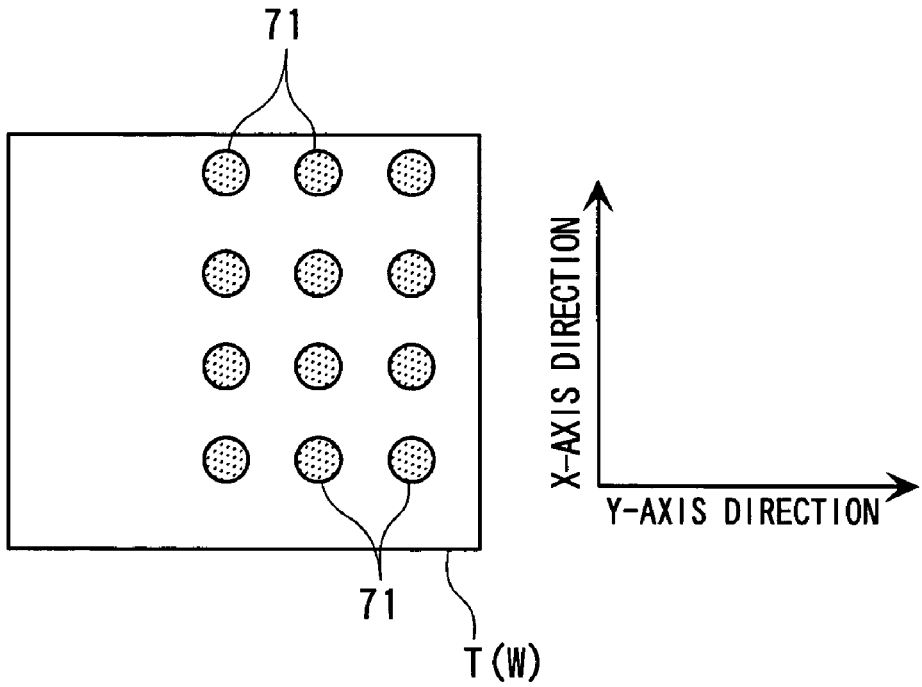
FIGS. 8A and 8B are plan views showing states of drawn dots and stippled dots which represent an inspection result.
Figure 8B:
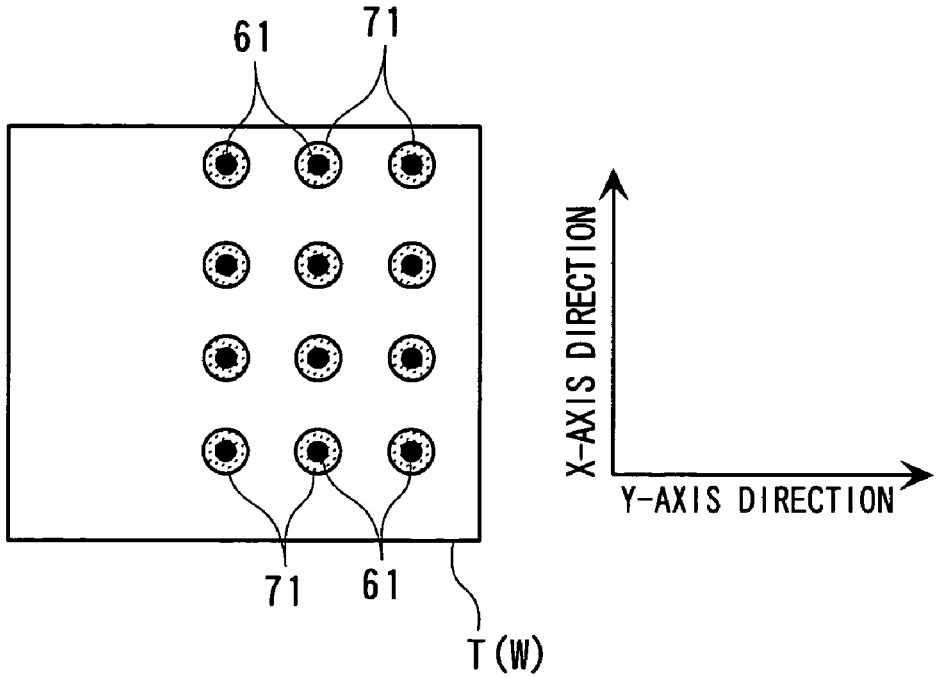

Furthermore, it is preferred that a stippling region of the workpiece W, and the surfaces of the dummy workpiece and the target plate T be applied with an organic coloring matter and the like whose color is developed or changed by a laser beam, so that a result of stippling is recognized clearly. As a result, the drawn dots 71 and the stippled dots 61 are marked at the same positions as shown in FIG. 8B as an example and thus it becomes easier to compare these dots. Accordingly, a state of positional deviation of the stippled dots and the drawn dots can be recognized more clearly.

Figure 9:
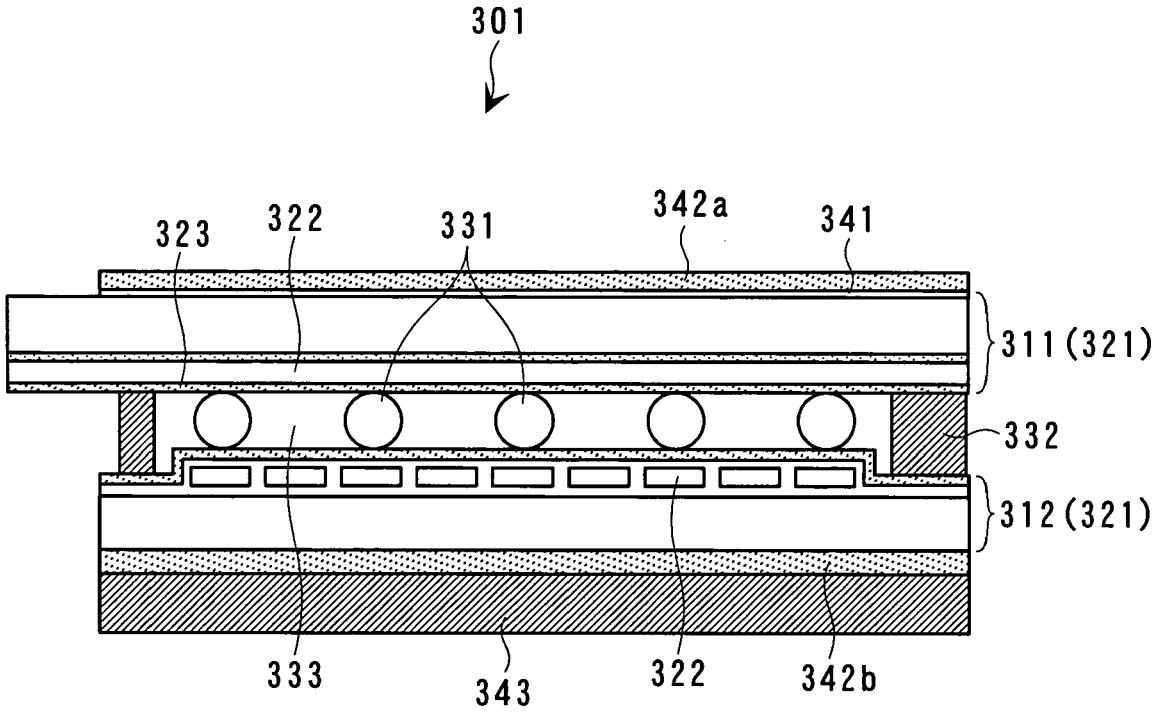
FIG. 9 is a cross-sectional view of a liquid crystal display device manufactured by using the liquid droplet ejection apparatus of the present invention.

Here, description is provided regarding a case where the above-described liquid droplet ejection apparatus 1 is used for manufacturing a liquid crystal display device. FIG. 9 shows a cross-sectional construction of a liquid crystal display device 301. As shown in this drawing, the liquid crystal display device 301 includes an upper substrate 311 having a transparent conductive coating (ITO film) 322 and an alignment layer 323 formed on opposite surface of a glass substrate 321, a lower substrate 312, a lower substrate 312, a multitude of spacers 331 provided between both of the upper and lower substrates 311 and 312, an end-sealing material 332 which seals a space between both of the upper and lower substrates 311 and 312, and liquid crystal 333 filled between both of the upper and lower substrate 311 and 312. Further, a phase substrate 341 and a polarizer 342*a* are stacked on the back side of the upper substrate 311. In addition, a polarizer 342*b* and a backlight 343 are stacked on the back side of the lower substrate 312.

In a normal manufacturing process, the transparent conductive coating 322 is patterned and the alignment layer 323 is applied on the glass substrate 321, thus making each of the upper and lower substrates 311 and 312. Thereafter, the spacers 331 and the end-sealing material 332 are formed on the lower substrate 312, and then the upper substrate 311 is adhered thereon. Next, the liquid crystal 333 is filled from a filling port of the end-sealing material 332, and the filling port is closed. Thereafter, the phase substrate 341, both of the polarizers 342*a* and 342*b*, and the backlight 343 are stacked.

The liquid droplet ejection apparatus 1 of this embodiment can be used for, for example, forming the spacers 331 and filling the liquid crystal 333. Namely, a spacer material (for example, ultraviolet curing resin and thermosetting resin) which forms the cell gaps, or the liquid crystal is introduced into the function liquid droplet ejection head as the function liquid, and evenly ejected (applied) at predetermined positions. First of all, the lower substrate 312 is set on the suction table 33. On the lower substrate 312, the end-sealing material 332 is printed in a circular shape. The spacer material is ejected onto the lower substrate 312 at rough intervals and irradiated with ultraviolet rays. Thus, the spacer material is solidified. Next, a predetermined amount of the liquid crystal 333 is uniformly ejected and filled in the inner side of the end-sealing material 332 on the lower substrate 312. Thereafter, the upper substrate 311 which has been separately prepared and the lower substrate 312 with the predetermined amount of liquid crystal applied thereon are brought into a vacuum and adhered to each other.

As described above, the liquid crystal 333 is uniformly applied (filled) within the cells before the upper and lower substrate 311 and 312 are adhered to each other. Therefore, it is possible to resolve a failure such as that the liquid crystal 333 is not fully filled in narrow areas such as corners of the cells.

By using ultraviolet curing resin or thermosetting resin as the function liquid (material for the end-sealing material), the above-described end-sealing material 332 can be printed by the liquid droplet ejection apparatus 1. Similarly, by introducing polyimide resin into the function liquid droplet ejection head as the function liquid (material for the alignment layer), the alignment layer 323 can also be formed by the liquid droplet ejection apparatus 1.

As set forth above, it can be assumed that various kinds of function liquids may be introduced to the function liquid droplet ejection head in manufacturing the liquid crystal display device 301. In the above-described liquid droplet ejection apparatus 1, the function liquid can be ejected (landed) by the function liquid droplet ejection head 5 with high accuracy. Therefore, the liquid crystal display device 301 can be manufactured stably and highly accurately.

The liquid droplet ejection apparatus 1 descried above can be used for manufacturing not only the above-described liquid crystal display device 301 mounted on electronic equipment such as a portable telephone and a personal computer, but also various kinds of electro-optic devices. To be specific, the liquid droplet ejection apparatus 1 of this embodiment can be used for manufacturing an organic EL device, an FED device (electron-emitting device), a PDP device, an electrophoretic display device and the like. In addition, the liquid droplet ejection apparatus 1 can be used for manufacturing a color filter of a liquid crystal display device, an organic EL device and the like.

Figure 10:
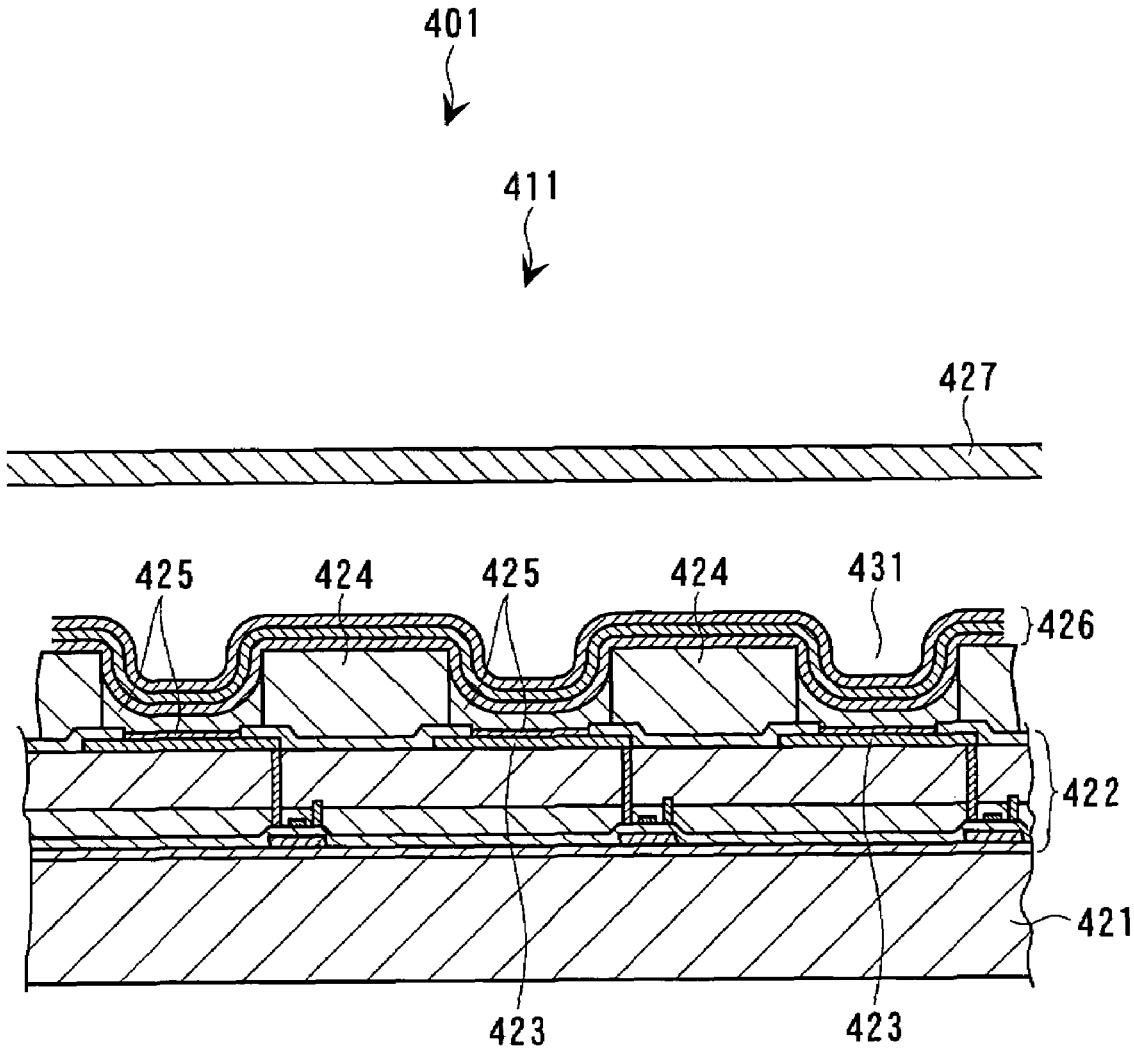
FIG. 10 is a cross-sectional view of an organic EL device manufactured by using the liquid droplet ejection apparatus of the present invention.

Next, an example is briefly described, in which the above-described liquid droplet ejection apparatus 1 is employed for manufacturing an organic EL device. As shown in FIG. 10, the organic EL device is made of an organic EL element 411 which is connected to wiring of a flexible printed circuit (not illustrated) and a driver IC (not illustrated). The organic EL element 411 includes a substrate 421, a circuit element portion 422, pixel electrodes 423, bank portions 424, light-emitting devices 425, a cathode 426 (counter electrode), and a sealing substrate 427. The circuit element portion 422 is formed on the substrate 421, and a plurality of pixel electrodes 423 are arrayed on the circuit element portion 422. The grid-shaped bank portions 424 are formed between each of the pixel electrodes 423. Each of the light-emitting devices 425 is formed in a concave opening 431 formed between the bank portions 424. The cathode 426 is formed over the entire top surfaces of the bank portions 424 and the light-emitting devices 425. On the cathode 426, the sealing substrate 427 is stacked.

In a manufacturing process of the organic EL device 401, the bank portions 424 are formed at predetermined positions on the substrate 421 (workpiece W) on which the circuit element portion 422 and the pixel elements 423 have been formed in advance. Thereafter, plasma treatment is performed for appropriately forming the light-emitting devices 425, and then the light-emitting devices 425 and the cathode 426 (counter electrode) are formed. Subsequently, the sealing substrate 427 is stacked on the cathode 426 to seal the same, and thereby the organic EL element 411 is obtained. Thereafter, the cathode 426 of the organic EL element 411 is connected to the wiring of the flexible printed circuit, and the wiring of the circuit element portion 422 is connected to the driver IC. Accordingly, the organic EL device 401 is manufactured.

The liquid droplet ejection apparatus 1 is used for forming the light-emitting devices 425. Specifically, a material of the light-emitting elements (function liquid) is introduced to the function liquid droplet ejection head 5. The material is then ejected, corresponding to the positions of the pixel electrodes 423 on the substrate 421 where the bank portions 424 are formed. The ejected material is then dried, thus forming the light-emitting devices 425. The liquid droplet ejection apparatus 1 can be used for forming the pixel electrodes 423, the cathodes 426 and the like by using a liquid material for the pixel electrodes 423, the cathodes 426 and the like.

Furthermore, for example, in a manufacturing method of an electron-emitting device, luminescence materials with colors of R, G, and B are introduced to the plurality of function liquid droplet ejection heads 5, respectively. Thereafter, the plurality of function liquid droplet ejection heads 5 are moved in the main scanning direction and the sub-scanning direction while selectively ejecting the luminescence materials. Thus, multiple phosphors are formed on an electrode.

In a manufacturing method of a PDP device, luminescence materials with colors of R, G, and B are introduced to the plurality of function liquid droplet ejection heads 5, respectively. The plurality of function liquid droplet ejection heads 5 are moved in the main scanning direction and the sub-scanning direction while selectively ejecting the luminescence materials. Thus, phosphors are formed in a plurality of concave portions on a rear substrate, respectively.

In a manufacturing method of an electrophoretic display device, electrophoretic materials with colors of R, G, and B are introduced to the plurality of function liquid droplet ejection heads 5, respectively. The plurality of function liquid droplet ejection heads 5 are moved in the main scanning direction and the sub-scanning direction while selectively ejecting the electrophoretic materials. Thus, phosphors are formed in multiple concave portions on an electrode, respectively. It is preferred that the electrophoretic materials, each being made of electrically charged particles and dye, be microcapsulated.

Other electro-optic devices may include those in which metal wiring, a lens, a resist, a light diffuser or the like is formed. The liquid droplet ejection apparatus 1 of this embodiment can also be used in manufacturing these various devices.

For example, in a method of forming the metal wiring, liquid metal materials are introduced to the plurality of function liquid droplet ejection heads 5, respectively. The plurality of function liquid droplet ejection heads 5 are moved in the main scanning direction and the sub-scanning direction while selectively ejecting the liquid metal materials. Thus, the metal wiring is formed on a substrate. For example, the liquid droplet ejection apparatus 1 can be used for forming metal wiring which connects the driver to each electrode in the foregoing liquid crystal display device. Alternatively, the liquid droplet ejection apparatus 1 can be used for forming metal wiring which connects TFT and the like to each electrode in the foregoing organic EL device. Accordingly, the forgoing liquid crystal display device and the organic EL device are manufactured. Needless to say, the liquid droplet ejection apparatus 1 can be applied to a general semiconductor manufacturing technology as well as to manufacturing methods of flat panel displays of the foregoing kinds.

In a method of forming a lens, lens materials are introduced in the plurality of function liquid droplet ejection heads 5, respectively. The plurality of function liquid droplet ejection heads 5 are moved in the main scanning direction and the sub-scanning direction while selectively ejecting the lens materials. Thus, multiple microlenses are formed on a transparent substrate. For example, the liquid droplet ejection apparatus 1 can be used in manufacturing a device for beam convergence in the foregoing FED device. The liquid droplet ejection apparatus 1 can also be applied to a technology for manufacturing various optical devices.

In the manufacturing method of a lens, translucent coating materials are introduced to the plurality of function liquid droplet ejection heads 5, respectively. The plurality of function liquid droplet ejection heads 5 are moved in the main scanning direction and the sub-scanning direction while selectively ejecting the coating material. Thus, a coating film is formed on each lens surface.

In a manufacturing method of resist, resist materials are introduced to the plurality of function liquid droplet ejection heads 5, respectively. The plurality of function liquid droplet ejection heads 5 are moved in the main scanning direction and the sub-scanning direction while selectively ejecting the resist materials. Thus, photoresist having an arbitrary shape is formed on a substrate. The liquid droplet ejection apparatus 1 is used for forming, for example, banks in the various display devices described earlier. As a matter of course, the liquid droplet ejection apparatus 1 can be widely used for applying photoresist in a photolithography method which is predominantly used in a semiconductor manufacturing technology.

In a method of forming a light diffuser, light diffusing materials are introduced to the plurality of function liquid droplet ejection heads 5, respectively. The plurality of function liquid droplet ejection heads 5 are moved in the main scanning direction and the sub-scanning direction while selectively ejecting the light diffusing material. Thus, multiple light diffusers are formed on a substrate. Needless to say, the liquid droplet ejection apparatus 1 can also be used for manufacturing various optical devices.

As described above, there is a possibility that various kinds of function liquids are introduced to the liquid droplet ejection apparatus 1. By using the above-described liquid droplet ejection apparatus 1 for manufacturing various kinds of electro-optic devices, it is possible to manufacture these electro-optic devices stably and highly accurately.

According to the inspection apparatus for inspecting the processing accuracy of the workpiece processing apparatus, bad accuracy due to mechanical accuracy of the moving mechanism and the bad accuracy due to processing accuracy of the processing mechanism can be easily distinguished. Thus, appropriate measures can be taken to address the bad accuracy.

According to the drawing accuracy inspection apparatus of the liquid droplet ejection apparatus and the liquid droplet ejection apparatus, it becomes possible to distinguish between bad accuracy due to mechanical accuracy of the moving mechanism and the bad accuracy due to ejection accuracy of the function liquid droplet ejection head. In addition, an appropriate measure can be taken for the bad accuracy based on an inspection result from the drawing accuracy inspection apparatus. Further, according to the workpiece of the present invention, inspection on accuracy can be easily conducted as necessary.

According to the electro-optic device, manufacturing method of the electro-optic device, and the electronic equipment, the electro-optic device is manufactured by using the liquid droplet ejection apparatus with fine drawing accuracy (landing accuracy of the function liquid). Thus, the electro-optic device having high quality and liability can be provided.

What is claimed is:

1. An inspection apparatus for inspecting a processing accuracy of a workpiece processing apparatus, said workpiece processing apparatus having a moving mechanism for mounting thereon a workpiece and a workpiece processing mechanism so that a workpiece surface is processed while performing a relative movement between the workpiece and said workpiece moving mechanism, said inspection apparatus comprising:

stippling means mounted on said moving mechanism in a side-by-side relationship with said workpiece processing mechanism, said stippling means performing visibly recognizable stippling onto the workpiece by irradiating coherent light onto the workpiece as a result of relative movement between the workpiece and said workpiece processing mechanism; and stippling control means for driving said stippling means to perform the stippling at a predetermined frequency timing.

2. An inspection apparatus for inspecting a drawing accuracy of a liquid droplet ejection apparatus, said liquid droplet ejection apparatus having a moving mechanism for mounting thereon a workpiece and a function liquid droplet ejection head, said moving mechanism performing a relative movement between the workpiece and said function liquid droplet ejection head so as to selectively eject the function liquid droplet from said function liquid droplet ejection head to perform drawing, said inspection apparatus comprising:

stippling means mounted on said moving mechanism in a side-by-side relationship with said function liquid droplet ejection head, said stippling means performing visibly recognizable stippling onto the workpiece by irradiating coherent light onto the workpiece as a result of relative movement between the workpiece and said function liquid droplet ejection head; and stippling control means for driving said stippling means to perform the stippling at a predetermined frequency timing.

3. The inspection apparatus according to claim 2, further comprising image recognition means for recognizing an image as a result of stippling by said stippling means.

4. The inspection apparatus according to claim 2, wherein said stippling means is made up of a laser irradiating mechanism which oscillates or focuses a laser beam.

5. The inspection apparatus according to claim 2, further comprising a target plate provided in a side-by-side relationship with the workpiece, instead of a stippled portion of the workpiece.

6. The inspection apparatus according to claim 2, further comprising a dummy workpiece for inspection purpose, instead of the workpiece.

7. The inspection apparatus according to claim 2, wherein said stippling control means drives said stippling means to perform stippling based on an ejection timing signal obtained from a head driver of said function liquid droplet ejection head.

8. The inspection apparatus according to claim 7, wherein said function liquid droplet ejection head ejects a function liquid for drawing inspection purpose, and wherein said stippling control means drives said stippling means to perform stippling in a manner synchronized with driving of said function liquid droplet ejection head.

9. The inspection apparatus according to claim 8, wherein said stippling control means comprises delaying means for delaying the stippling by the stippling means by a period equivalent to a duration from ejection of the function liquid by said function liquid droplet ejection head until landing of the function liquid on the workpiece.

10. A liquid droplet ejection apparatus comprising the inspection apparatus for inspecting a drawing accuracy of a liquid droplet ejection apparatus according to claim 2.

11. A workpiece which is stippled by the liquid droplet ejection apparatus according to claim 10, wherein the workpiece has, outside an area for function liquid droplet ejection, a stippling area for stippling by said stippling means and a drawing area for inspection purpose for drawing said function liquid droplet ejection head.

12. The workpiece according to claim 11, wherein said stippling area is coated with a coloring matter whose color is developed or changed by light irradiated from the stippling means.

13. A method of manufacturing an electro-optic device, wherein a deposited portion is formed by ejecting a function liquid droplet onto a workpiece from the function liquid droplet ejection head, by using said liquid droplet ejection apparatus according to claim 10.

* * * * *

UNITED STATES PATENT AND TRADEMARK OFFICE

CERTIFICATE OF CORRECTION

PATENT NO. : 7,059,705 B2
APPLICATION NO. : 10/757358
DATED : June 13, 2006
INVENTOR(S) : Yuji Iwata It is certified that error appears in the above-identified patent and that said Letters Patent is hereby corrected as shown below:

Col. 1, line 8: After "No.", insert -- 2003-007511 --.

Col. 1, line 8: After "filed", insert -- January 15, 2003 --.

Col. 4, line 23 (second occurrence): After "cleaning", "of" should be -- or --.

Col. 4, line 53: "above-descried" should be -- above-described --.

Col. 5, line 21: "preset" should be -- present --.

Col. 11, line 13 (second occurrence): delete second occurrence of "a lower substrate 312,".

Col. 12, line 9: "descried" should be -- described --.

Signed and Sealed this

Third Day of April, 2007

JON W. DUDAS
*Director of the United States Patent and Trademark Office*